US006607562B2

(12) United States Patent
Ghorashi et al.

(10) Patent No.: US 6,607,562 B2
(45) Date of Patent: Aug. 19, 2003

(54) MOISTURE WICKING ARAMID FABRIC AND METHOD FOR MAKING SUCH FABRIC

(75) Inventors: Hamid M. Ghorashi, Midlothian, VA (US); Daniel Routhier, Quebec (CA)

(73) Assignee: EI Consoltex Inc., Quebec (CA)

( * ) Notice: Subject to any disclaimer, the term of this patent is extended or adjusted under 35 U.S.C. 154(b) by 351 days.

(21) Appl. No.: 09/769,123

(22) Filed: Jan. 25, 2001

(65) Prior Publication Data

US 2001/0008823 A1 Jul. 19, 2001

Related U.S. Application Data

(62) Division of application No. 09/158,755, filed on Sep. 23, 1998, now abandoned.
(60) Provisional application No. 60/060,215, filed on Oct. 1, 1997.

(51) Int. Cl.[7] ..... D06M 1/00; D06M 1/02; C09K 21/00; D04H 1/00

(52) U.S. Cl. ..... 8/115.51; 8/115.6; 8/115.7; 8/130.1; 252/608; 442/327; 442/414

(58) Field of Search ..... 252/608; 8/115.51, 8/115.6, 115.7, 130.1; 442/327, 414

(56) References Cited

U.S. PATENT DOCUMENTS

| | | | |
|---|---|---|---|
| 4,525,168 | A | 6/1985 | Kelly |
| 4,755,335 | A | 7/1988 | Ghorashi |
| 5,096,459 | A | 3/1992 | Ghorashi |
| 5,150,476 | A | 9/1992 | Statham et al. |
| 5,202,086 | A | 4/1993 | Baliga et al. |
| 5,275,627 | A | 1/1994 | Cates et al. |
| 5,362,555 | A | 11/1994 | Lal |
| 5,499,663 | A | 3/1996 | Barbeau et al. |
| 5,858,888 | A | 1/1999 | Underwood et al. |
| 5,928,971 | A | 7/1999 | Ellis et al. |

OTHER PUBLICATIONS

DuPont Technical Information Bulletin, NOMEX® Aramid Fiber, Bulletin NX–12, Jyly 1978, Textile Fibers Department, Technical Service Section, E.I. DuPont de Nemours & Co. (Inc.), Wilmington, Delaware, 19899 "*Laundering and Drycleaning Garments of NOMEX® Aramid Fiber*".

*Primary Examiner*—Mark Kopec
*Assistant Examiner*—D G Hamlin

(57) ABSTRACT

The present invention provides a durable to a wicking aramid fabric formed from crystallized aramid yarns or mixtures of aramid and other yarns for use in firefighter turnout gear and other protective apparel and a process for making this durable wicking fabric.

8 Claims, No Drawings

MOISTURE WICKING ARAMID FABRIC AND METHOD FOR MAKING SUCH FABRIC

This application is a divisional of Ser. No. 09/158,755 filed on Sep. 23, 1998 which is now abandoned, which claims the benefit of provision application No. 60/060,215, filed on Oct. 1, 1997.

The present invention relates to a wicking aramid fabric formed from crystallized yarns for use in firefighter turnout gear and other protective apparel.

BACKGROUND OF THE INVENTION

Several recent patents, including U.S. Pat. Nos. 5,323,815; 5,499,663 and 5,539,928 have taught the advantage of using a multifilament fabric for the inner lining of fire fighter turnout gear. Such multifilament yarn fabrics, in contrast to staple yarn fabrics, provide a more slippery fabric surface which increases the flexibility and mobility of garments and increases the ease of movement of the fire fighter as he or she works while wearing the garment.

Although wearer comfort is improved by the use of such multifilament fabrics as the inner lining or as a facing for other fabric layers of the turnout gear, multifilament yarn fabrics, in contrast to staple or spun yarn fabrics, have poor water wicking properties. And although the fire fighter can move with more comfort because the multifilament yarn fabric offers less resistance to movement, moisture and perspiration produced by the fire fighter's own metabolism builds up on the skin since it is not wicked away by the filament yarns in contact with the skin. The fire fighter becomes uncomfortable, and the fire fighter's wet skin surface aggravates the ease of movement that the garment was designed to achieve.

All fabrics used in the construction of fire fighter protective clothing must pass minimum performance requirements for resistance to flame, heat and tearing. Thus the inner lining of protective garments designed for fire fighters and garments designed for others who work in environments where there is a danger of exposure to flame and high temperature are usually made from aramid fibers and yarns. Most often these aramid yarns and fibers used in the construction of protective clothing have been subjected to a hot stretching operation in manufacture to fully develop fiber mechanical properties. Such fibers and yarns are substantially, if not fully, crystallized.

It is well known in the art that m-aramid crystallized or substantially crystallized yarns and fabrics have closed surfaces and are difficult to dye or otherwise size or treat with yarn or fabric finishes. For example, U.S. Pat. No. 5,096,459 teaches that it is necessary to treat crystallized m-aramid yarns or fabrics with steam at a temperature of at least 120° C. for about 15 minutes in order for water soluble dyes and carrier, padded on these fibers and yarns to be absorbed.

U.S. Pat. No. 4,755,335 taught that even treatments applied to never dried m-aramid yarns and fibers required contact with steam at a temperature of from 110 to 140° C. for adequate absorption of the treatment to take place.

U.S. Pat. No. 4,525,168 teaches that it is necessary to swell the crystallized m-aramid fabric or yarn by immersing the fabrics or yarns in a solvent such as dimethyl formamide, dimethyl sulfoxide or dimethyl acetamide for a period of 30 minutes in order to open the yarn surface so that a dye site may be introduced and the crystallized polymer may be successfully dyed.

The object of the present invention is to provide a wicking, crystallized yarn, aramid fabric for use in protective clothing including fire fighter turnout gear and other types of protective clothing. Another object of the present invention is to provide a process for making such a fabric.

SUMMARY OF THE INVENTION

The present invention is a wicking fabric comprising aramid crystallized yarns, and in particular the fabric of the present invention is comprised of 75% by weight or more aramid crystallized yarns.

The aramid crystallized yarns used in the present invention are staple yarns, multifilament yarns or mixtures of staple and multifilament yarns and are formed from m-aramid, p-aramid or mixtures of m- and p-aramid fibers. It is preferred that the major component of the fabric of the present invention is m-aramid yarn.

The fabric of the present invention is particularly useful in a protective and is a preferred fabric for a garment that is fire fighter turnout gear comprising an outer shell, a moisture barrier and a thermal barrier.

The garment of the present invention includes protective coats or overalls.

The present invention also includes a process for making a wicking fabric wherein the fabric contains more than 75% aramid crystallized yarns comprising the steps:

(a) padding the fabric with a water solution containing from 10 to 800 grams per liter of polar solvent;

(b) allowing the solution to remain in contact with the fabric at room temperature for a time sufficient to swell the fibers of the fabric, but not more than 36 hours;

(c) padding the fabric with a solution of a wicking finish; and (d) drying the fabric at a temperature not more than 200° C. for a period of not more than 30 minutes.

Polar solvent useful in the present process are those selected from the group consisting of dimethyl acetamide, dimethyl formamide and dimethyl sulfoxide.

In the present process, it is preferred that padding is run at a pad pressure that results in a 1% to a 70% pick-up of solution based on the dry weight of the fabric. It is also preferred practice that before step (d) the padded fabric is kept from drying out. If the concentration of solvent remaining in fabrics treated according to the present method is of concern, the method may be run so that the final concentration of solvent in the fabric after drying is less than 1% by weight by:

(a) padding the fabric with a water solution containing about 25 grams per liter of polar solvent at a pad pressure that results in a 10 to 50% by weight pick-up of solution by the fabric;

(b) allowing the solution to remain in contact with the fabric at room temperature for about 16 hours;

(c) padding the fabric with a solution of a wicking finish; and (d) drying the fabric at a temperature not more than 200° C. for a period of not more than 30 minutes. Polar solvents for this method include those selected from the group consisting of dimethyl acetamide, dimethyl formamide and dimethyl sulfoxide. In this version of the present method, it is preferred that the padding is run at a pad pressure that results in a 1% to a 70% pick-up of solution based on the dry weight of the fabric. It is also the preferred practice that before step (d) the padded fabric is kept from drying out.

DETAILED DESCRIPTION

As used herein the term wicking fabric means a fabric that wicks initially and continues to wick after at least 15 washings. Durability of the wicking finish on the fabric is important to the function and service life of the garments made from such fabrics. Wicking is tested by observing the diffusion of a water droplet on the surface of a fabric. When a water droplet contacts the surface of a wicking fabric the droplet diffuses into the fabric in a radial pattern. The absence of such a radial pattern denoted the failure of a fabric to wick away water which contacts the fabric's surface.

Washing as used herein means a series of wash, rinse and dry cycles used to laundry a fabric. In washing, a detergent is used at the normal concentration level to clean the fabric of dirt and oil.

The present invention provides a wicking fabric of crystallized aramid yarns. The fabric of the present invention retains its wicking capacity for at least 15 washings. The aramid yarn may be m-aramid, p-aramid or mixtures of these aramid yarns. A fabric where m-aramid is the major component is preferred. For use as the inner lining of fire fighter turnout gear, it is especially preferred that the fabric of the present invention be a m-aramid fabric formed from multifilament yarns.

The fabric of the present invention may be woven or knitted. Although a plain weave or twill is preferred for most uses of this fabric, any weave pattern for the fabric or method of weaving or knitting the fabric may be used in making the fabric of the present invention.

The present invention provides a process of making a wicking fabric containing more than 75% aramid crystallized yarns. The process comprises the steps of:

(a) padding the fabric with a water solution containing from 10 to 800 grams per liter of polar solvent;

(b) allowing the solution to remain in contact with the fabric at room temperature for a time sufficient to swell to fibers, but not more than 36 hours;

(c) padding the fabric with a solution of a wicking finish; and (d) drying the fabric at a temperature not greater than 200° C. for a period of about 30 minutes.

The wicking fabric of the present invention may be used in a variety of applications including use protective apparel and fire fighter turnout gear.

The actual time between the padding on of the solvent solution and the padding on of the wickable finish depends on the concentration of the solvent in the solvent-water solution. Higher concentrations of solvent require shorter times to activate the surface of the aramid yarns so that they accept the finish and produce a durable wicking fabric. Higher concentrations of solvent in the solvent-water solution also reduce the amount of pickup of the solvent solution by the fabric required during the padding process. It is preferred that the padding operation is run at a pad pressure that results in a 1 to 70% pickup of the solution based on the weight of the dry fabric.

In many applications where the wearer's skin is to be in direct contact with the fabric of the present invention, it is desirable to keep the solvent content of the fiber as low as possible since not all of the solvent may be removed from the fabric surface during the drying step. The present invention provides a process in which the final concentration of solvent in the fabric is less than 1% by weight. This preferred process comprises the steps of:

(a) padding the fabric with a water solution containing from 25 grams per liter of polar solvent at a pad pressure that results in a 10 to 50% by weight pickup of the solution by the fabric;

(b) allowing the solution to remain in contact with the fabric at room temperature for about 16 hours;

(c) padding the fabric with a solution of a wicking finish; and (d) drying the fabric at a temperature not greater than 200° C. for a period of about 30 minutes.

It is preferred in any variation of the present process to keep the padded fabric from drying out. Any is technique know in the art for preventing drying out of the fabric is acceptable to use with the present process.

The preferred solvent for activating the surface of the aramid crystallized yarns is dimethyl acetamide. Other polar solvents may be used to activate yarn surface, for example dimethyl formamide or dimethyl sulfoxide. For each solvent there is a preferred low concentration between 1 to 5% by weight of the water solution that will activate the surface of the aramid yarns to accept the wicking or other fabric finish or dye. At these low concentrations the amount of solvent remaining in the fabric after the drying step is at levels less than about 1% and is low enough to allow the treated fabric to be used applications requiring that the treated fabric to be in direct skin contact with the wearer.

The process of the present invention provides a durable wicking fabric for crystallized aramid yarn fabrics. The crystallized aramid yarn may be multifilament or staple. The yarns may be m-aramid or p-aramid or mixtures of these yarns. The present process is of particular value for producing a durable wicking fabric of multifilament m-aramid yarns. Multifilament crystallized yarns are known to be difficult to treat with surface finishes resulting in durable properties. A multifilament m-aramid fabric of crystallized yarns that is simply padded with a suitable wicking finish looses its wickability in five or fewer wash cycles in contrast to the durability of the finish achieved by the present process.

The present process also provides a more durable and uniform fabric finish for fabrics composed of staple yarns or mixtures of staple and multifilament yarns.

The present process may be applied to fabrics that contain aramid fibers as a minor component allowing the finish of the fabric to be more uniform across the surface of all yarns that make up the fabric.

It is also possible in the present process to include other fabric finishes or dyes mixed with the wicking finish that is padded on the fabric. In this way a crystallized m-aramid fabric may be treated and dyed in one step.

In a fabric having more than 75% of the weight of the fabric as aramid yarns, the fabric has the character, at least in absorbing dye, fabric treatments and finishes, of an aramid fabric. Protective apparel uses may require some mix of multifilament or staple aramid yarns with other yarns, or may require that the protective fabric be 100% by weight aramid filament or multifilament yarns. The present invention provides durable wicking m-aramid crystallized filament yarns and fabrics even when the fabric is 100% by weight crystallized, m-aramid filament yarns. For fabrics containing less than 100% to about 75% crystallized m-aramid filament yarns, the remain yarns are selected for the required protective properties. Such yarns may be other yarns of high temperature stability such as p-aramid, amorphous m-aramid, treated cotton, wool or rayon and polybenzimidazole yarns.

The present process may be used to provide a durable wicking finish to fabrics made from or containing as a major component p-aramid filament or staple yarns.

The wicking finish may be any of many finishes known to be suitable for application on polyamide fibers. Such finishes must be those that may be successfully applied by padding. Concentrations of such finishes in the water solution padded on the fabric are those typically used in the art of fabric finishing. A preferred wicking/soil release finish for use in the present invention is sold as REPEL-0-TEX PSR 200 available from Rhon-Poulenc.

As used herein a m-aramid fiber or yarn is one containing at least 25 mole % (with respect to the polymer) of the recurring structural unit having the following formula, $$[—CO—R^1—CO—NH—R^2—NH—], \quad (I)$$

The $R^1$ and/or $R^2$ in one molecule can have one and the same meaning, but they can also differ in a molecule within the scope of the definition given.

If $R^1$ and/or $R^2$ stand for any bivalent aromatic radicals whose valence bonds are in the meta-position or in a comparable angled position with respect to each other, then these are mononuclear or polynuclear aromatic hydrocarbon radicals or else heterocyclic-aromatic radicals which can be mononuclear or polynuclear. In the case of heterocyclic-aromatic radicals, these especially have one or two oxygen, nitrogen or sulphur atoms in the aromatic nucleus.

Polynuclear aromatic radicals can be condensed with each other or else be linked to each other via C—C bonds or via bridge groups such as, for instance, —O—, —$CH_2$—, —S—, —CO— or $SO_2$—.

Examples of polynuclear aromatic radicals whose valence bonds are in the meta-position or in a comparable angled position with respect to each other are 1,6-naphthylene, 2,7-naphthylene or 3,4'-biphenyldiyl. A preferred example of a mononuclear aromatic radical of this type is 1,3-phenylene.

The preferred m-aramid polymer is MPD-I or copolymers containing at least 25 mole % (with respect to the polymer) MPD-I.

As used herein a p-aramid fiber or yarn is one containing at least 25 mole % (with respect to the polymer) of the recurring structural unit having the following formula, $$[—CO—R^1—CO—NH—R^2—NH—], \quad (I)$$

The $R^1$ and/or $R^2$ in one molecule can have one and the same meaning, but they can also differ 20 in a molecule within the scope of the definition given.

If $R^1$ and/or $R^2$ stand for any bivalent aromatic radicals whose valence bonds are in the para-position or in a comparable angled position with respect to each other, then these are mononuclear or polynuclear aromatic hydrocarbon radicals or else heterocyclic-aromatic radicals which can be mononuclear or polynuclear. In the case of heterocyclic-aromatic radicals, these especially have one or two oxygen, nitrogen or sulfur atoms in the aromatic nucleus.

Polynuclear aromatic radicals can be condensed with each other or else be linked to each other via C—C bonds or via bridge groups such as, for instance, —O—, —$CH_2$—, —S—, —CO— or $SO_2$—.

The preferred p-aramid polymer is PPD-T or copolymers containing at least 25 mole % (with respect to the polymer) PPD-T.

M-aramid and p-aramid fibers and yarns suitable for use in the fabric and process of the present invention are those sold under the Trademarks KEVLAR and NOMEX of the DuPont Company, CONEX of Teijin and equivalent products offered by others.

The fabric of the present invention may be used in fire fighter turnout gear. Such gear usually includes garments such as a coat and pants and any other article of clothing needed to provide protection for heat and flame to the wearer. Generally such garments are made of a series of layers of fabrics. Typically such a garment has an outer shell usually made of abrasion resistant material, a moisture barrier made from water resistant material and a thermal barrier. Generally the m-aramid filament lining material is used as a facing on the thermal barrier so that it is in contact with the skin of the wearer. It is anticipated that this will be a preferred use of the fabric of the present invention, but the fabric of the invention may be used in other layers of the garment where its use will bring value and comfort.

The fabric of the present invention can also be used alone or in combinations with other fabrics in other types of protective garments. For example, the fabric may be used alone in a protective coat or coverall or as a lining for such garment.

What is claimed is:

1. A process for making a wicking fabric wherein the fabric contains more than 75% aramid crystallized yarns comprising the steps:

(a) padding the fabric with a water solution containing from 10 to 800 grams per liter of polar solvent;

(b) allowing the solution to remain in contact with the fabric at room temperature for a time sufficient to swell the fibers of the fabric, but not more than 36 hours;

(c) padding the fabric with a solution of a wicking finish; and (d) drying the fabric at a temperature not more than 200° C. for a period of not more than 30 minutes.

2. The process of claim 1 wherein the polar solvent is selected from the group consisting of dimethyl acetamide, dimethyl formamide and dimethyl sulfoxide.

3. The process of claim 1 wherein the padding is run at a pad pressure that results in a 1% to a 70% pick-up of solution based on the dry weight of the fabric.

4. The process of claim 1 wherein before step (d) the padded fabric is kept from drying out.

5. A process for making a wicking fabric wherein the fabric contains aramid crystallized yarns and wherein the final concentration of solvent in the fabric after drying is less than 1% by weight comprising the steps:

(a) padding the fabric with a water solution containing about 25 grams per liter of polar solvent at a pad pressure that results in a 10 to 50% by weight pick-up of solution by the fabric;

(b) allowing the solution to remain in contact with the fabric at room temperature for about 16 hours;

(c) padding the fabric with a solution of a wicking finish; and (d) drying the fabric at a temperature not more than 200° C. for a period of not more than 30 minutes.

6. The process of claim 5 wherein the polar solvent is selected from the group consisting of dimethyl acetamide, dimethyl formamide and dimethyl sulfoxide.

7. The process of claim 5 wherein the padding is run at a pad pressure that results in a 1% to a 70% pick-up of solution based on the dry weight of the fabric.

8. The process of claim 5 wherein before step (d) the padded fabric is kept from drying out.

* * * * *